US009496646B2

(12) United States Patent
Kawashima

(10) Patent No.: US 9,496,646 B2
(45) Date of Patent: Nov. 15, 2016

(54) POSTURE HOLDING LEVER TYPE CONNECTOR

(71) Applicant: Yazaki Corporation, Tokyo (JP)

(72) Inventor: Kenichi Kawashima, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/941,811

(22) Filed: Nov. 16, 2015

(65) Prior Publication Data

US 2016/0141798 A1 May 19, 2016

(30) Foreign Application Priority Data

Nov. 17, 2014 (JP) ..... 2014-232806

(51) Int. Cl.
*H01R 13/62* (2006.01)
*H01R 13/64* (2006.01)
*H01R 13/629* (2006.01)

(52) U.S. Cl.
CPC ..... *H01R 13/62938* (2013.01); *H01R 13/64* (2013.01)

(58) Field of Classification Search
CPC ..... H01R 13/62933; H01R 13/62938; H01R 13/62955; H01R 13/62988
USPC ..... 439/372, 157
See application file for complete search history.

(56) References Cited

U.S. PATENT DOCUMENTS 8,215,970 B2 * 7/2012 Shamoto ..... H01R 13/5213 439/157
8,215,979 B2 * 7/2012 Shamoto ..... H01R 13/62938 439/372
8,251,761 B2 * 8/2012 Shamoto ..... H01R 13/62938 439/892
8,353,712 B2 * 1/2013 Makino ..... H01R 13/62938 439/157
8,419,462 B2 * 4/2013 Tanaka ..... H01R 13/62938 439/157
2012/0034812 A1 2/2012 Tanaka et al.
2015/0004829 A1 * 1/2015 Aoki ..... H01R 13/62938 439/372

FOREIGN PATENT DOCUMENTS

JP 2012-038498 A 2/2012

* cited by examiner

*Primary Examiner* — Hae Moon Hyeon
(74) *Attorney, Agent, or Firm* — Sughrue Mion, PLLC

(57) ABSTRACT

A lever type connector includes a first connector housing, a second connector housing having a hood into which the first connector housing is fitted, and a fitting operation lever coupled to the first connector housing. The fitting operation lever is rotatable from a rotation start position to a rotation end position to completely fit the first and second connector housings to each other. The first connector housing includes a temporarily locking portion to temporarily lock the fitting operation lever at the rotation start position. The second connector housing includes a temporal-locking releasing portion to release the fitting operation lever from being temporarily locked by the temporarily locking portion. The fitting operation lever includes a posture holding tab configured to fill a space between the hood and the first connector housing to hold the first connector housing and the fitting operation lever in a posture parallel to the hood.

4 Claims, 16 Drawing Sheets

POSTURE HOLDING LEVER TYPE CONNECTOR

CROSS-REFERENCE TO RELATED APPLICATIONS

The present application claims priority from Japanese Patent Application No. 2014-232806 filed on Nov. 17, 2014, the entire content of which is incorporated herein by reference.

FIELD OF INVENTION

The present invention relates to a lever type connector.

RELATED ART

FIGS. 12-16 illustrate a related art lever type connector 100 (see, e.g., JP2012-38498A).

As shown in FIG. 12, the lever type connector 100 has a first connector housing 110, a second connector housing 120 into which the first connector housing 110 is fitted, and a fitting operation lever 130 rotatably coupled to a side surface 111 of the first connector housing 110. The first connector housing 110 is fitted into the second connector housing 120 by rotating the fitting operation lever 130.

The first connector housing 110 has, on each side surface 111 (on a top surface and a bottom surface in FIG. 12), a pair of lever supporting pivots 112*a*, 112*b* for rotatably supporting the fitting operation lever 130, a temporarily locking portion 113 for temporarily locking the fitting operation lever 130 at a rotation start position, and guide projections 114 configured to slidably fit into housing guide grooves 121 of the second connector housing 120.

The temporarily locking portions 113, which are lock projections that project from the side surfaces 111, cause the fitting operation lever 130 to be locked temporarily at a rotation start position (described later) by coming into contact with engagement tongues 135 (described later) of the fitting operation lever 130.

The second connector housing 120 has, at the tip side, a substantially rectangular hood 122 inside which the first connector housing 110 is to be inserted. The hood 122 has the housing guide grooves 121 to be fitted slidably with the guide grooves 114 of the first connector housing 110, at such positions as to correspond to the guide grooves 114.

The fitting operation lever 130 has a pair of lever bodies 131 whose middle portions in the longitudinal direction are rotatably coupled to the side surfaces 111 of the first connector housing 110, housing acting portions 132 which are located at one ends of the respective lever bodies 131 and are to be engaged rotatably with respective lever engagement portions of the second connector housing 120, and an operation portion 133 which links the other end portions of the lever bodies 131.

As shown in FIG. 13, each lever body 131 is coupled to the first connector housing 110 so as to be rotatable along the associated side surface 111 of the first connector housing 110 when the associated pair of lever supporting pivots 112*a*, 112*b* of the first connector housing 110 are fitted into a pair of fulcrum holes 134*a*, 134*b* provided at an intermediate location on the lever body 131 in the longitudinal direction.

The pair of fulcrum holes 134*a*, 134*b* formed in each lever body 131 are arc-shaped long holes and restrict the rotation range of the lever body 131 on the first connector housing 110. More specifically, the pair of fulcrum holes 134*a*, 134*b* allows the lever body 131 to rotate from the rotation start position (i.e., the position shown in FIG. 13) to a rotation end position.

Each lever body 131 has an engagement tongue 135 extending parallel to the associated side surface 111 of the first connector housing 110 in a direction in which the first connector housing 110 is fitted into the second connector housing 120 (in the direction X1 in FIG. 12). As shown in FIG. 13, each lever body 131 (fitting operation lever 130) is temporarily locked at the rotation start position as a result of contact of a distal end face 135*a* of the engagement tongue 135 to a contact surface 113*a* of the associated temporarily locking portion 113 of the first connector housing 110.

When the engagement tongue 135 is deflected in a direction in which its distal end face 135*a* moves away from the side surface 111 (the direction Y1 in FIG. 12), the lever body 131 that has been temporarily locked by the temporarily locking portion 113 is released from the locked state and is allowed to move over the temporarily locking portion 113.

When the temporal locking by the temporarily locking portions 113 is released, the fitting operation lever 130 is allowed to rotate toward the fitting end position in the direction R1 in FIG. 13.

FIG. 13 also illustrates electric wires 140 connected to terminal fittings housed inside the first connector housing 110.

When the first connector housing 110 on which the first connector housing 110 is locked temporarily at the rotation start position and the second connector housing 120 are put together in a fitting start position as shown in FIG. 14, the housing acting portions 132 are rotatably engaged with respective lever lock portions provided inside the hood 122 of the second connector housing 120.

When the first connector housing 110 and the second connector housing 120 are suitably put together in the fitting start position, as shown in FIG. 15 a releasing force receiving tab 136 that projects from a side of each engagement tongue 135 slides onto a temporal-locking releasing slant surface 125*a* provided in a corresponding engagement tongue insertion groove 125 of the second connector housing 120, whereby a distal end portion of the engagement tongue 135 is deflected in a direction away from the side surface 111. As a result of the deflection of the distal end portion of each engagement tongue 135, each engagement tongue 135 is disengaged from the temporarily locking portion 113, whereby the fitting operation lever 130 is released from the temporarily locked state.

That is, when first connector housing 110 and the second connector housing 120 are properly put together in the fitting start position, the temporal locking of the fitting operation lever 130 is released and the fitting operation lever 130 is allowed to rotate from the rotation start position to the rotation end position.

When rotating the fitting operation lever 130, a finger is placed on the operation portion 133. With the connector housings 110, 120 being properly put together in the fitting start position as shown in FIG. 14, the fitting operation lever 130 is rotated by pushing the operation portion 133 in the direction R2 in FIG. 14. As the fitting operation lever 130 rotates, the operation portion 133, the pairs of fulcrum holes 134*a*, 134*b*, and the housing acting portions 132 function as a lever force application point, action points, and fulcrums, respectively, to move the first connector housing 110 in the direction in which the first connector housing 110 and the second connector housing 120 are further fitted to each other.

When the fitting operation lever 130 is rotated to the rotation end position, the fitting between the connector housings 110, 120 is completed.

When fitting the connector housings 110, 120 to each other by rotating the fitting operation lever 130, the fitting operation lever 130 functions as a lever. Therefore, the fitting between the connector housings can be completed with smaller operation force than in a case in which the connector housings are fitted by directly pushing them in the fitting direction.

However, in this related art lever type connector 100, in an initial state of fitting in which the first connector housing 110 and the second connector housing 120 are put together in the fitting start position, there remains a small play between the connector housings 110, 120. Therefore, as shown in FIG. 16, if a load R3 in the direction of the play acts on the first connector housing 110 and the fitting operation lever 130 from the electric wires 140 housed in the first connector housing 110, the load R3 causes the first connector housing 110 and the fitting operation lever 130 to incline with respect to the second connector housing 120 by an angle θ.

With the first connector housing 110 and the fitting operation lever 130 being inclined with respect to the second connector housing 120, the releasing force receiving tab 136 shown in FIG. 15 may fail to slide onto the temporal-locking releasing slant surface 125*a* provided inside the engagement tongue insertion groove 125 of the second connector housing 120 when the connector housings 110, 120 are put together in the fitting start position, in which case the temporal locking state of the fitting operation lever 130 cannot be released.

Further, if the fitting operation lever 130 is strongly pushed with the temporal locking state of the fitting operation lever 130 not being released, the fitting operation lever 130 may be damaged.

Therefore, according to the related art lever type connector 100, the connector housings 110, 120 need to be carefully put together in the fitting start position so as not to incline the first connector housing 110 and the fitting operation lever 130, resulting in a low working efficiency.

SUMMARY

Illustrative aspects of the present invention provide a lever type connector in which a fitting operation lever can released from its temporarily locked state in a reliable manner without requiring stressful work.

According to an illustrative aspect of the present invention, a lever type connector includes a first connector housing, a second connector housing having a hood into which the first connector housing is fitted, and a fitting operation lever rotatably coupled to a side surface of the first connector housing. The fitting operation lever is configured to be operated, in a state in which the first connector housing and the second connector housing are put together in a fitting start position, to rotate from a rotation start position to a rotation end position to completely fit the first connector housing and the second connector housing to each other. The first connector housing includes a temporarily locking portion provided on the side surface of the first connector housing to temporarily lock the fitting operation lever at the rotation start position. The second connector housing includes a temporal-locking releasing portion provided on an inner surface of a side wall of the hood to release the fitting operation lever from being temporarily locked by the temporarily locking portion. The fitting operation lever includes a lever body and a posture holding tab formed integrally with the lever body. The posture holding tab is configured to fill a space between the hood and the first connector housing to hold the first connector housing and the fitting operation lever in a posture parallel to the hood.

According to the lever type connector described above, the temporal locking state of the fitting operation lever provided on the first connector housing can be released reliably when the connector housings are put together in the fitting start position. Further, no stressful work is necessary in cancelling the temporal locking state. The connector housings can be fitted to each other as soon as the connector housings are put together in the fitting start position.

Other aspects and advantages of the invention will be apparent from the following description, the drawings and the claims.

DETAILED DESCRIPTION

Hereinafter, an exemplary embodiment of the present invention will be described in detail with reference to FIGS. 1 to 11.

Figure 1:
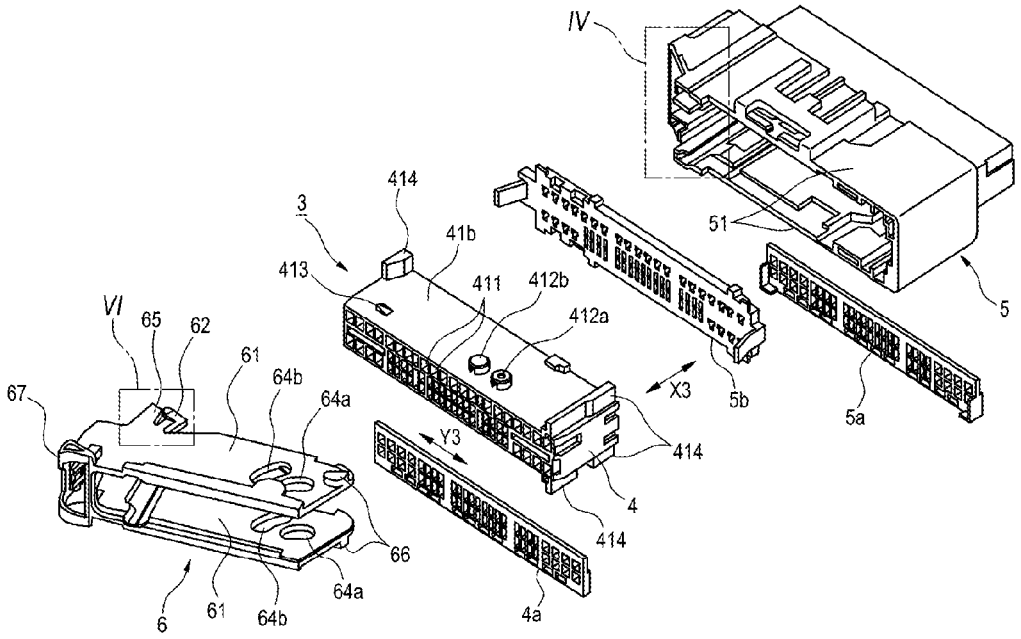
FIG. 1 is an exploded perspective view of a lever type connector according to an exemplary embodiment of the present invention.

As shown in FIG. 1, a lever type connector 3 according to an exemplary embodiment of the present invention has a first connector housing 4, a first spacer 4*a* to be attached to the first connector housing 4 inside the first connector housing 4 to improve holding of terminal fittings (female terminal fittings) by the first connector housing 4, a second connector housing 5 into which the first connector housing 4 is fitted, a second spacer 5*a* to be attached to the second connector housing 5 inside the second connector housing 5 to improve holding of terminal fittings (male terminal fittings) by the second connector housing 5, an aligning plate 5*b* to be attached to the second connector housing 5 inside the second connector housing 5 so as to be movable in a direction in which the connector housings 4, 5 are fitted to each other to protect the terminal fittings inside the second connector housing 5 and to correct the alignment of the terminal fittings, a fitting operation lever 6 to be rotatably coupled to side surfaces 41*b* of the first connector housing 4 and operated to fit the connector housings 4, 5 to each other, temporarily locking portions 413 provided on the first connector housing 4, temporal-locking releasing portion 52 (see FIG. 4) provided on the second connector housing 5, and posture holding tabs 65 formed integrally with respective lever bodies 61 of the fitting operation lever 6.

Figure 2:
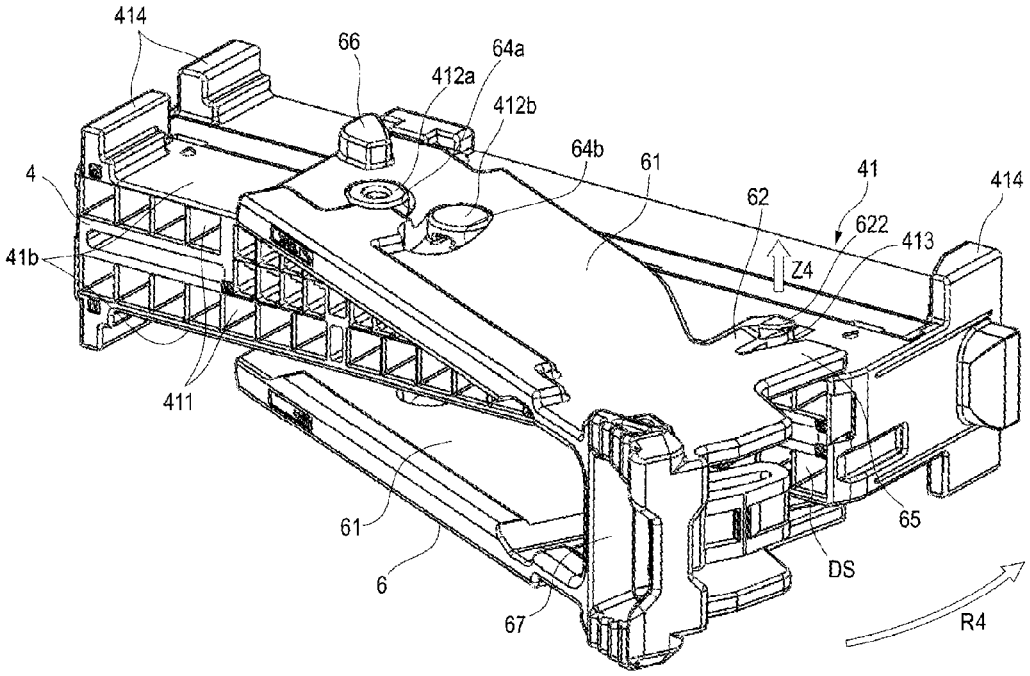
FIG. 2 is a perspective view illustrating a state in which a fitting operation lever and a first connector housing shown in FIG. 1 are attached together.

As shown in FIGS. 1 and 2, the first connector housing 4 has a substantially rectangular housing body 41 in which plural terminal housing holes 411 are arranged in plural stages, a pair of lever supporting pivots 412*a*, 412*b* that project from each of flat top and bottom side surfaces 41*b*, the temporarily locking portions 413 provided on the respective side surfaces 41*b* and causes the fitting operation lever 6 to be locked temporarily at a rotation start position, and guide projections 414 to be fitted slidably into housing guide grooves 53 (see FIG. 5) of the second connector housing 5.

As shown in FIG. 2, pairs of lever supporting pivots 412*a*, 412*b* are fitted into pairs of fulcrum holes 64*a*, 64*b* formed in the lever bodies 61 of the fitting operation lever 6, respectively, and thereby rotatably support the respective lever bodies 61 (fitting operation lever 6). Each lever body 61 of the fitting operation lever 6 is shaped like a plate and is laid on the associated side surface 41*b* of the first connector housing 4.

The temporarily locking portions 413 are provided to project from the respective side surfaces 41*b*, and are configured to block the fitting operation lever 6 from rotating beyond the rotation start position toward a rotation end position (in the direction R4 in FIG. 2) by contacting distal end faces 621 (see FIG. 6) of engagement tongues 62 of the fitting operation lever 6 so that, as shown in FIG. 2, the fitting operation lever 6 are locked temporarily at the rotation start position.

The guide projections 414 extend in the direction in which the connector housings 4, 5 are fitted to each other (i.e., in the direction X3 in FIG. 1), and are formed at both ends, in the width direction (the direction Y3 in FIG. 1), of each of the top and bottom side surfaces 41*b* of the first connector housing 4.

Figure 3:
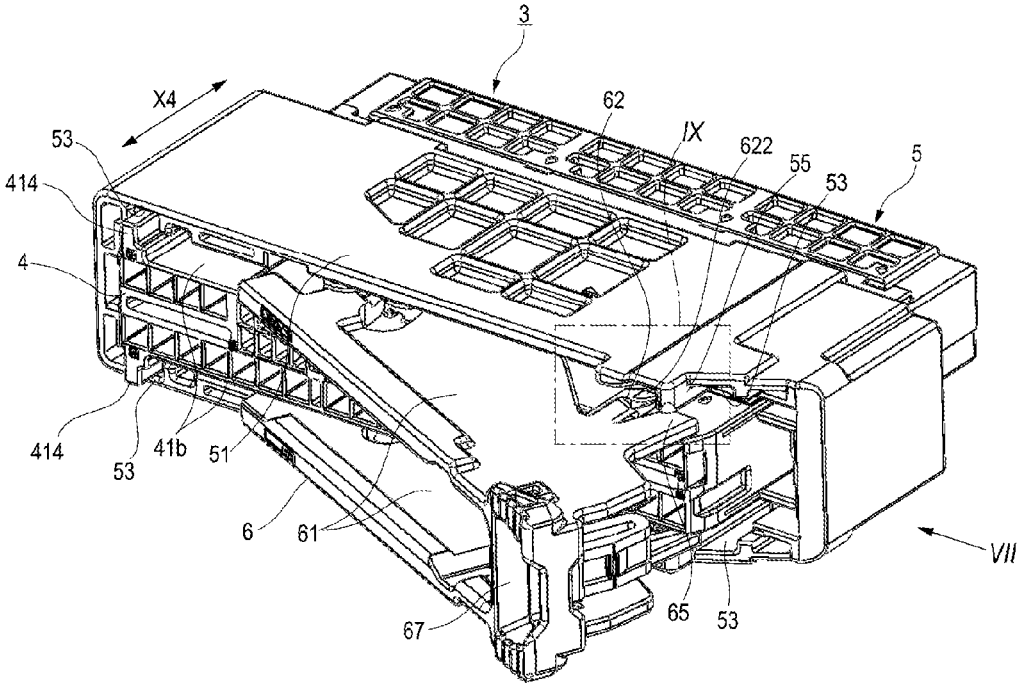
FIG. 3 is a perspective view illustrating a state in which the first connector housing and a second connector housing of the lever type connector shown in FIG. 1 are temporarily put together in a fitting start position.

As shown in FIG. 3, the guide projections 414 are fitted into the housing guide grooves 53 of the second connector housing 5 in a sliding manner in the direction in which the connector housings 4, 5 are fitted to each other (in the direction X4 in FIG. 3) so as to suppress unnecessary play at the time of fitting the connector housings 4, 5 to each other.

Figure 4:
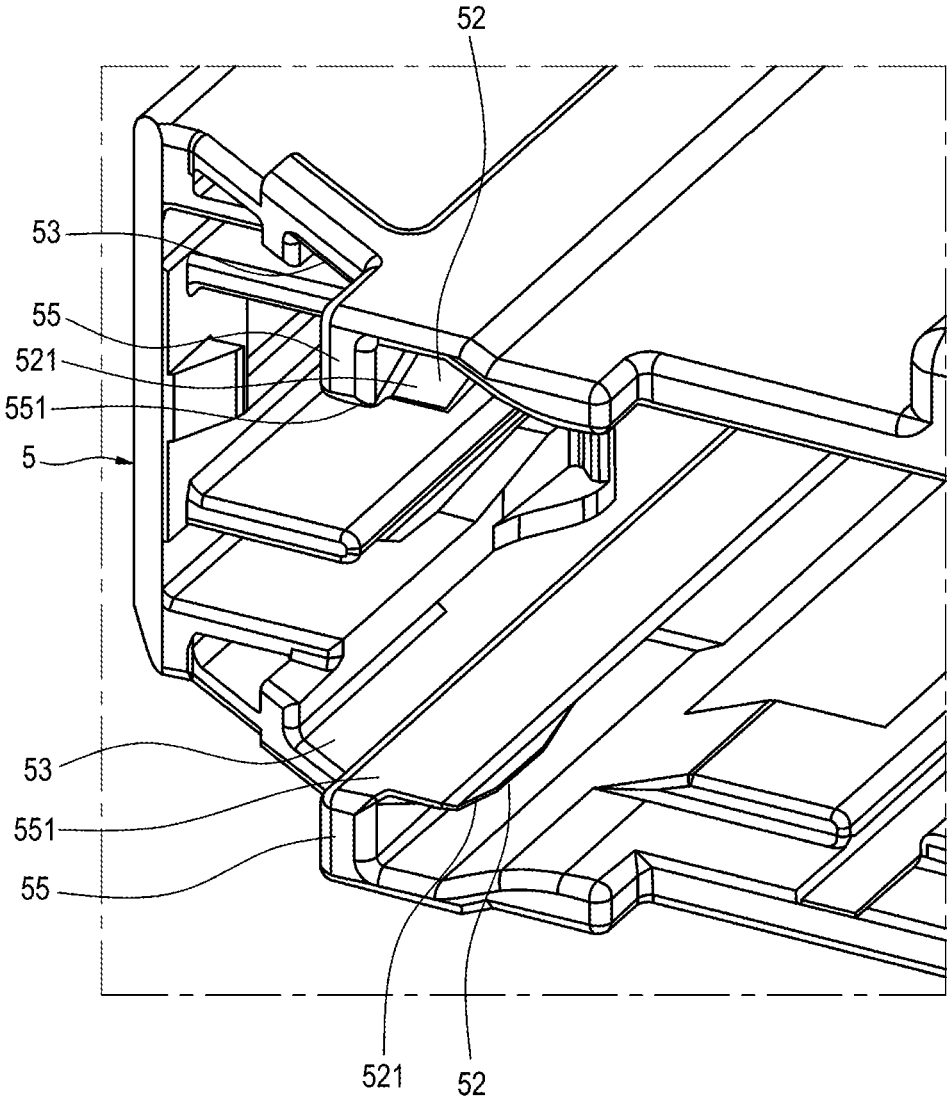
FIG. 4 is an enlarged view of the portion IV of the second connector housing shown in FIG. 1.
Figure 5:
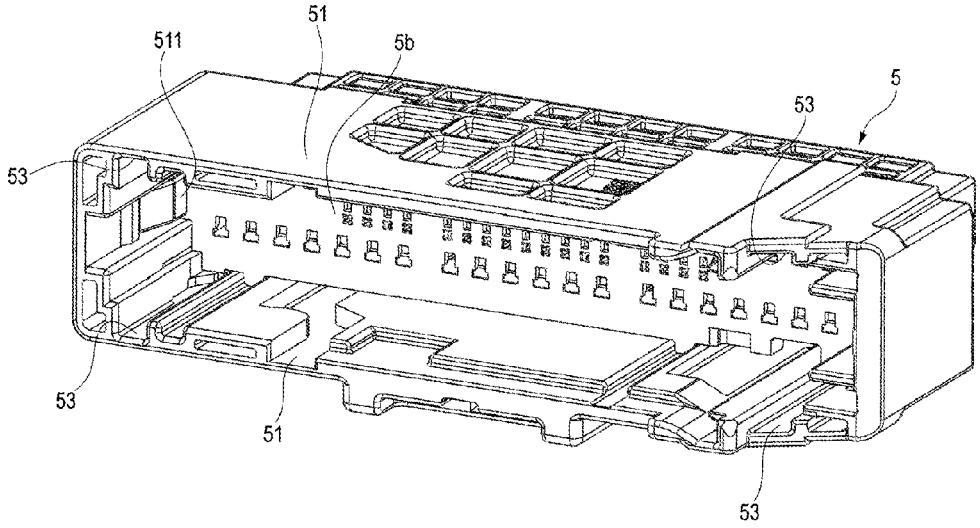
FIG. 5 is a perspective view of the second connector housing that is left-right-reversed from the one shown in FIG. 1.

The second connector housing 5 has a substantially rectangular hood 51 inside which the first connector housing 4 is to be inserted. As shown in FIGS. 4 and 5, the hood 51 has, inside, the temporal-locking releasing portion 52, the housing guide grooves 53, and lever lock portions (not shown).

As shown in FIG. 5, the aligning plate 5*b* which is incorporated in the second connector housing 5 is prevented from coming off by coming-off prevention arms 511 that are formed on inner wall surfaces of the hood 51. A lock position of the coming-off prevention arms 511 is a temporary position that is closer to the opening side than a regular attachment position; the aligning plate 5*b* can move deeper beyond the temporary position. When the first connector housing 4 is fitted into the second connector housing 5, the aligning plate 5*b* is moved deeper following the fitting of the first connector housing 4.

The temporal-locking releasing portion 52 are formed on the inner surfaces of the side walls, opposed to the respective side surfaces of the first connector housing 4, of the hood 51. As shown in FIG. 4, each temporal-locking releasing portion 52 has a slant surface 521 that is inclined with respect to the direction in which the connector housings 4, 5 are fitted to each other.

The slant surface 521 is configured such that a releasing force receiving tab 622 (see FIG. 6) projecting from one side of the engagement tongue 62 slides onto the slant surface 521 when the first connector housing 4, on which the fitting operation lever 6 is temporarily locked at the rotation start position, is in a fitting start position in a proper posture.

The term "proper posture" of the first connector housing 4 means a posture that it is parallel to the inner surfaces of the side walls of the hood 51 and its center axis direction is parallel to the center axis direction of the second connector housing 5.

When the releasing force receiving tab 622 on one side of the engagement tongue 62 slides onto the slant surface 521 of the temporal-locking releasing portion 52, the slant surface 521 causes a distal end portion of the engagement tongue 62 to deform in a deflecting manner in a direction in which the distal end portion moves away from the housing body 41 (in the direction Z4 in FIG. 2) to allow the engagement tongue 62 to move over the temporarily locking portion 413. That is, with regard to each temporal-locking releasing portion 52 used in the exemplary embodiment, the associated releasing force receiving tab 622 of the fitting operation lever 6 slides onto the slant surface 521 when the first connector housing 4 is in the fitting start position with the posture that is parallel to the inner surfaces of the side walls of the hood 51. Thus, the temporal-locking releasing portion 52 cancels the temporal locking state provided by the temporarily locking portions 413 and allows the fitting operation lever 6 to rotate to the rotation end position.

The housing guide grooves 53 are provided on the inner surfaces of the hood 51 at locations corresponding to the positions of the guide projections 414 on the first connector housing 4 so that the guide projections 414 of the first connector housing 4 are fitted into the housing guide grooves 53 in a sliding manner. The housing guide grooves 53 extend in the direction in which the connector housings 4, 5 are fitted to each other so as to suppress unnecessary play between the connector housings 4, 5 and to smoothly fit the connector housings 4, 5 to each other.

As shown in FIGS. 1 and 2, the fitting operation lever 6 has the pair of lever bodies 61 rotatably coupled to the housing body 41 of the first connector housing 4, the engagement tongues 62 and the posture holding tabs 65 that are formed integrally with the respective lever bodies 61, housing acting portions 66 formed at one ends of the lever bodies 61, respectively, and an operation portion 67 connecting the other ends of the lever bodies 61.

Each of the pair of lever bodies 61 is shaped like a plate and is laid on the associated side surface 41*b* of the first connector housing 4, and has the pair of fulcrum holes 64*a*, 64*b* with which the pair of lever supporting pivots 412*a*, 412*b* on the associated side surface 41*b* are engaged.

The pair of fulcrum holes 64*a*, 64*b* are arc-shaped long holes that are fitted slidably with the pair of lever supporting pivots 412*a*, 412*b*, respectively, and serve to connect the lever body 61 to the associated side surface 41*b* in such a manner that the lever body 61 can rotate from the rotation start position to the rotation end position.

Figure 6:
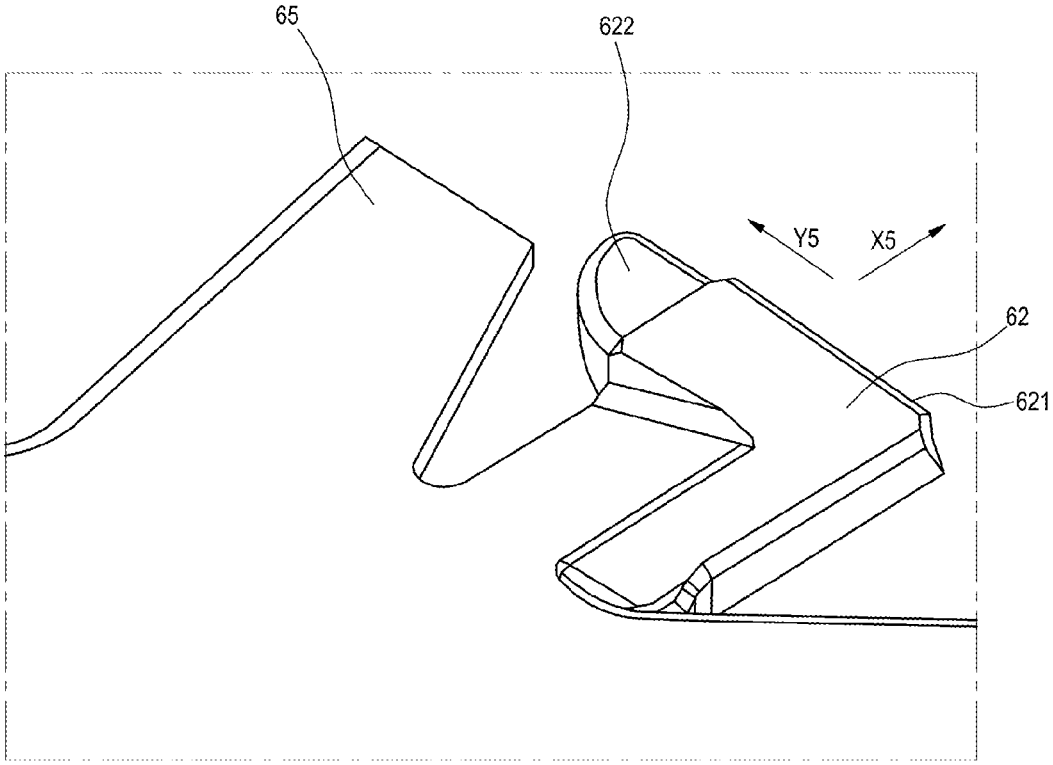
FIG. 6 is an enlarged view of the portion VI of the fitting operation lever shown in FIG. 1.
Figure 7:
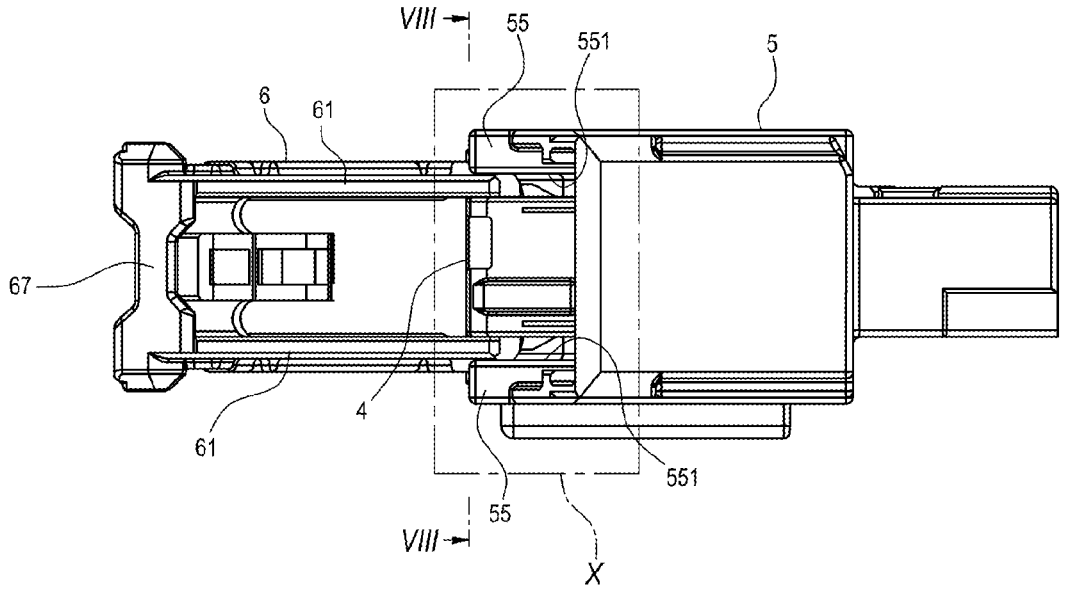
FIG. 7 is a side view as viewed from the direction VII in FIG. 3.

As shown in FIG. 6, each engagement tongue 62 is a strip-shaped plate piece that extends from the associated lever body 61 in the direction in which the connector housings are fitted to each other (in the direction X5 in FIG. 6). As shown in FIG. 2, each engagement tongue 62 positions the lever body 61 (i.e., fitting operation lever 6) at the rotation start position by its distal end face's coming into contact with the associated temporarily locking portion 413 of the housing body 41.

As shown in FIG. 6, on one side of the engagement tongue 62, the releasing force receiving tab 622 is provided to project in a connector width direction (the direction Y5 in FIG. 6) that is perpendicular to the extending direction of the engagement tongue 62.

In a state in which the first connector housing 4, on which the fitting operation lever 6 is locked temporarily at the rotation start position by means of the temporarily locking portions 413, is in the fitting start position with a posture that is parallel to the inner surfaces of the side walls of the hood 51 of the second connector housing 5, the releasing force receiving tabs 622 slides onto the slant surfaces 521 of the respective temporal-locking releasing portion 52 and cancels the temporal locking state provided by means of the temporarily locking portions 413 by causing the distal end portions of the engagement tongues 62 to deflect in directions away from the respective side surfaces 41*b*.

As shown in FIG. 6, each posture holding tab 65 is a strip-shaped plate piece that extends beside the engagement tongue 62 from the associated lever body 61 in the direction in which the connector housings are fitted to each other.

Figure 8:
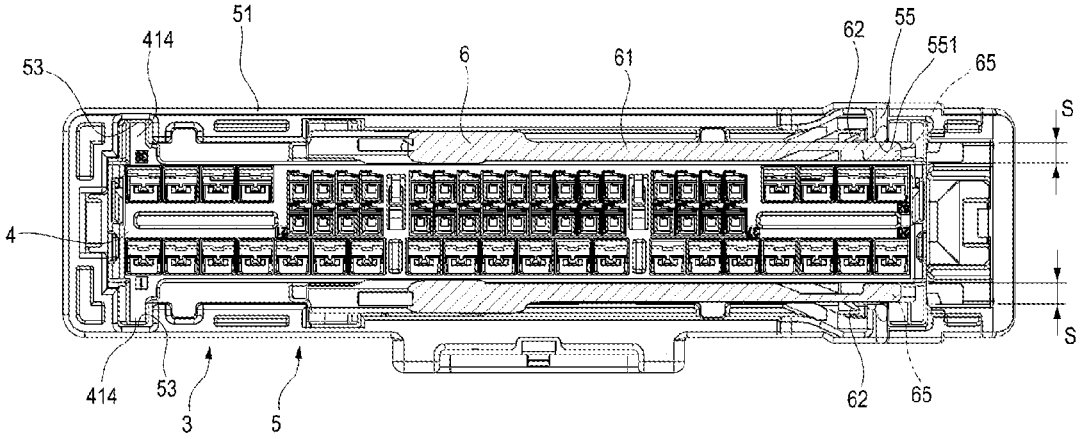
FIG. 8 is a sectional view taken along the line VIII-VIII in FIG. 7.
Figure 9:
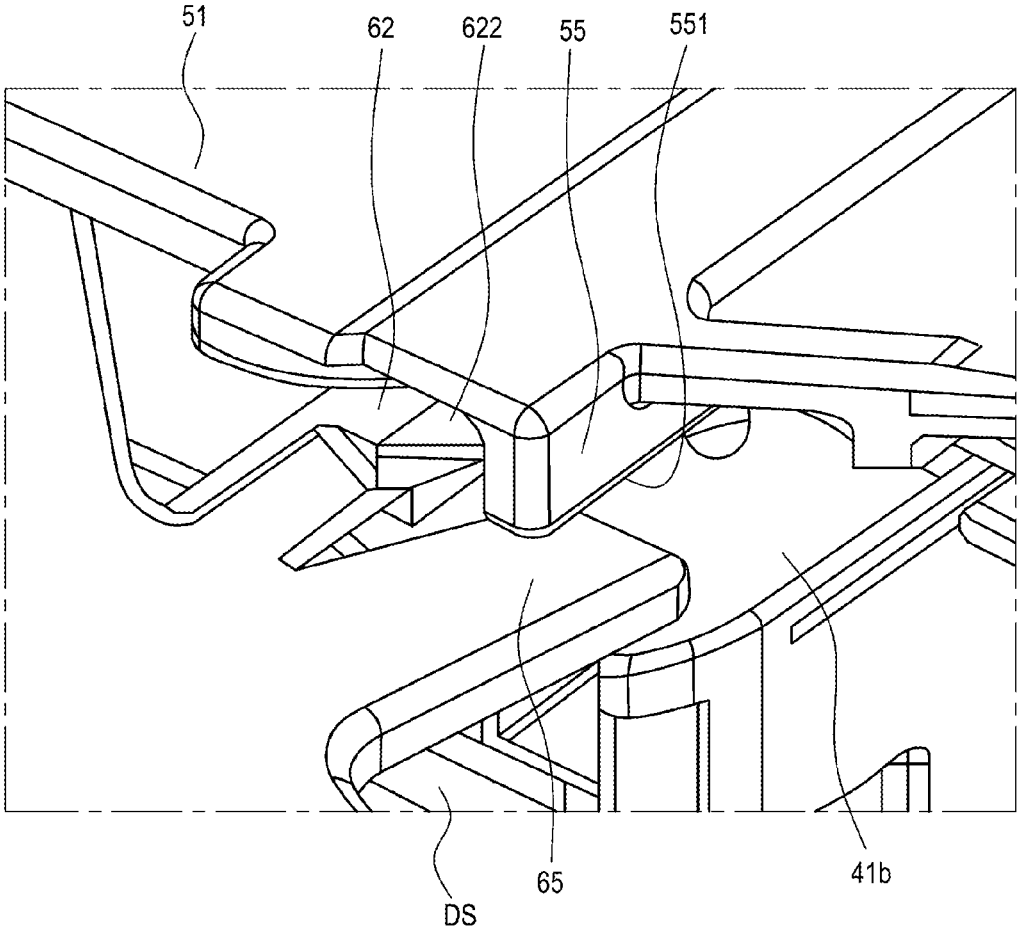
FIG. 9 is an enlarged view of the portion IX of FIG. 3.
Figure 10:
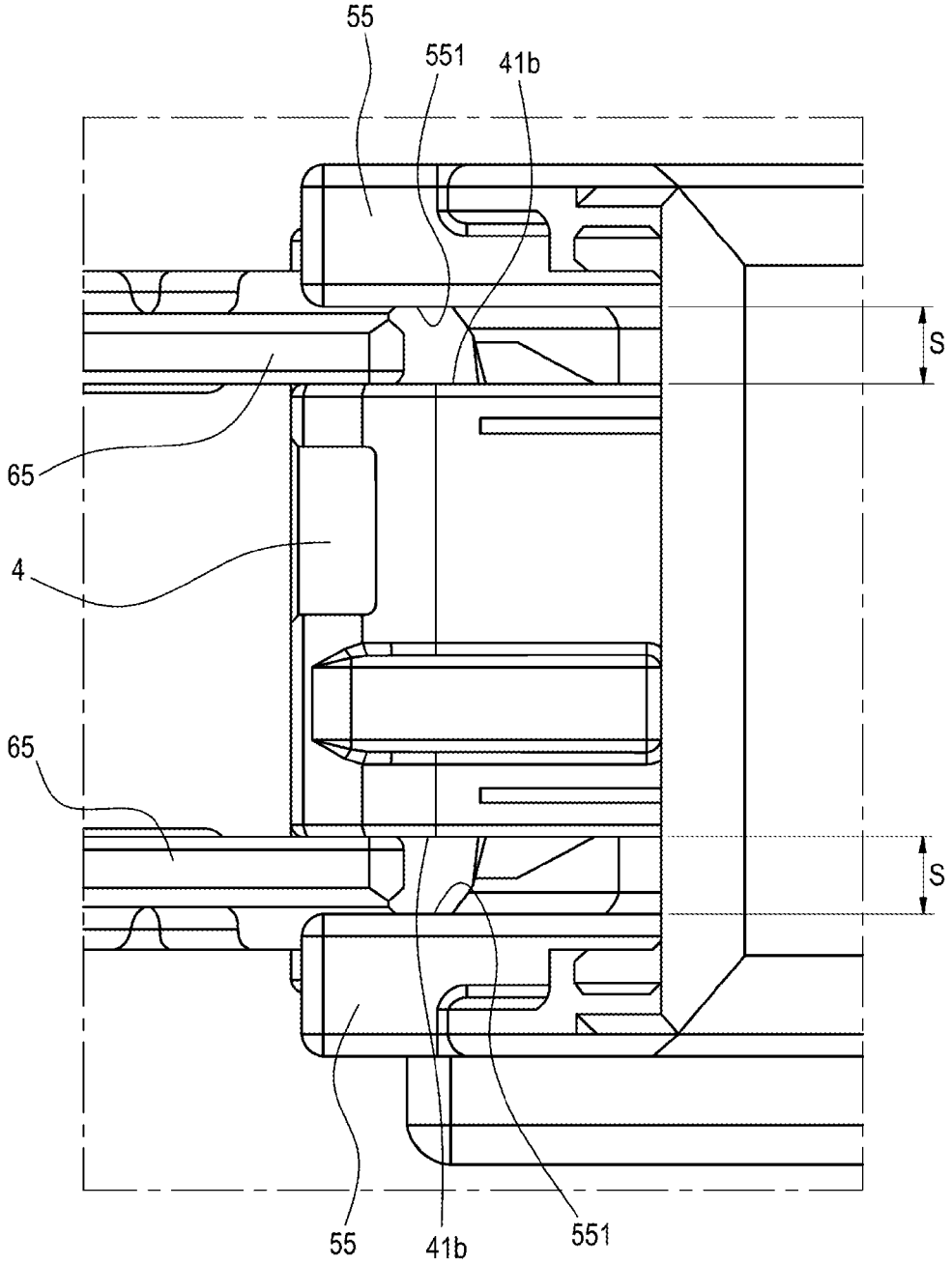
FIG. 10 is an enlarged view of the portion X of FIG. 7.

In a state in which the first connector housing 4 is in the fitting start position, as shown in FIGS. 8 to 10, each posture holding tab 65 fills a space S (see FIGS. 8 and 10) between a distal end face 551 of a vertical rib 55 (an inner surface of the side wall of the hood 51) and the side surface 41*b* of the first connector housing 4 to hold the first connector housing 4 and the fitting operation lever 6 in a posture parallel to the inner surface of the side wall of the hood 51.

In other words, when the first connector housing 4 is in the fitting start position, each posture holding tab 65 is fitted into the space S between the distal end face 551 of the vertical rib 55 and the side surface 41*b* of the first connector housing 4 and sandwiched between the distal end face 551 and the side surface 41*b* (see FIG. 10), thereby preventing the first connector housing 4 and the fitting operation lever 6 from inclining in the hood 51.

In the exemplary embodiment, each posture holding tab 65 extends from the portion, closer to its other end, of the associated lever body 61 in the direction in which the connector housings 4, 5 are fitted each other. The posture holding tabs 65 also serve as wire jamming prevention pieces which close approximately V-shaped spaces DS (see FIG. 2) that are defined between the fitting operation lever 6 and the first connector housing 4 or the second connector housing 5 and into which an external electric wire can enter.

As shown in FIG. 3, the housing acting portions 66, provided at the one ends of the lever bodies 61, respectively, are engaged rotatably with respective lever engagement portions (not shown) formed in the second connector housing 5 when the first connector housing 4 and the second connector housing 5 are put together in the fitting start position.

The operation portion 67 is provided at the other ends of the lever bodies 61. The operation portion 67 is configured such that a finger is placed on the operation portion 67 when rotating the fitting operation lever 6.

With the fitting operation lever 6 described above, when the first connector housing 4 and the second connector housing 5 are put together in the fitting start position in a state that the fitting operation lever 6 is temporarily locked at the rotation start position by means of the temporarily locking portions 413 of the first connector housing 4, as shown in FIG. 9 the spaces S between the distal end faces 551 of the vertical ribs 55 and the side surfaces 41*b* are filled by the posture holding tabs 65 and the first connector housing 4 and the fitting operation lever 6 are attached to the second connector housing 5 in a posture parallel to the inner surfaces (e.g., distal end faces 551) of the side walls of the second connector housing 5. Therefore, the releasing force receiving tabs 622 of the fitting operation lever 6 reliably slide onto the slant surfaces 521 of the temporal-locking releasing portion 52, respectively, as a result of which the distal end portions of the engagement tongues 62 are deformed to deflect in directions away from the respective side surfaces 41*b* of the first connector housing 4 and the temporal locking state provided by means of the temporarily locking portions 413 is canceled reliably.

Therefore, the temporal locking state of the fitting operation lever 6 can be canceled reliably by putting the first connector housing 4 and the second connector housing 5 together in the fitting start position, whereby the fitting operation lever 6 is allowed to rotate from the rotation start position to the rotation end position.

When the fitting operation lever 6 has been rotated to the rotation end position, the operation portion 67 functions as a lever force application point, the pairs of fulcrum holes 64*a*, 64*b* function as lever action points where the first connector housing 4 is caused to apply forces, and the housing acting portions 66 function as lever fulcrums for application of forces to the second connector housing 5. Therefore, fitting between the first connector housing 4 and the second connector housing 5 can be completed with smaller operation force than in a case in which the connector housings 4, 5 are fitted to each other by directly pushing them together in the fitting direction.

Figure 11:
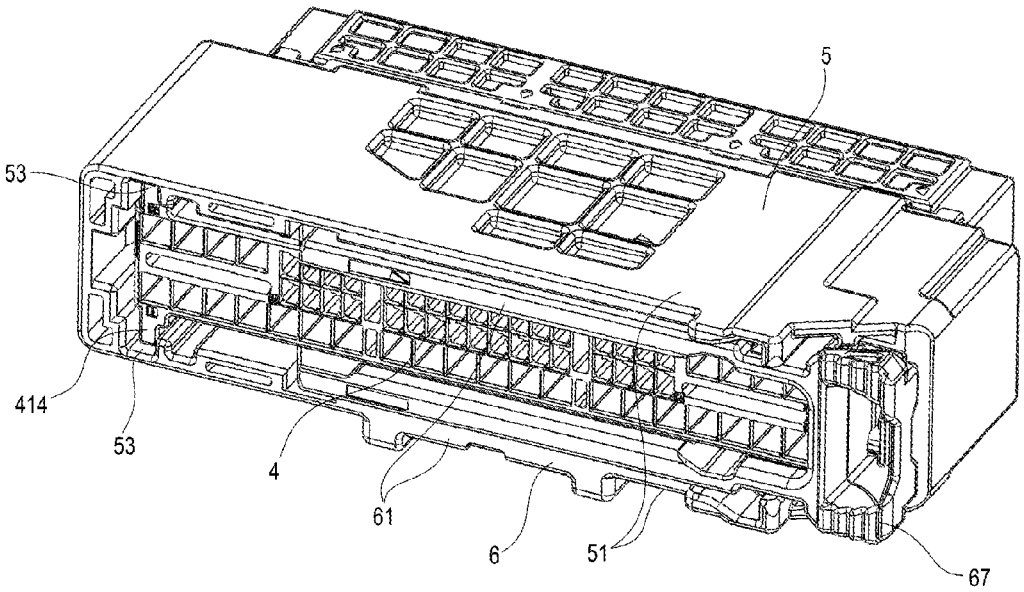
FIG. 11 is a perspective view illustrating a state in which the first connector housing and the second connector housing are completely fitted to each other.
Figure 12:
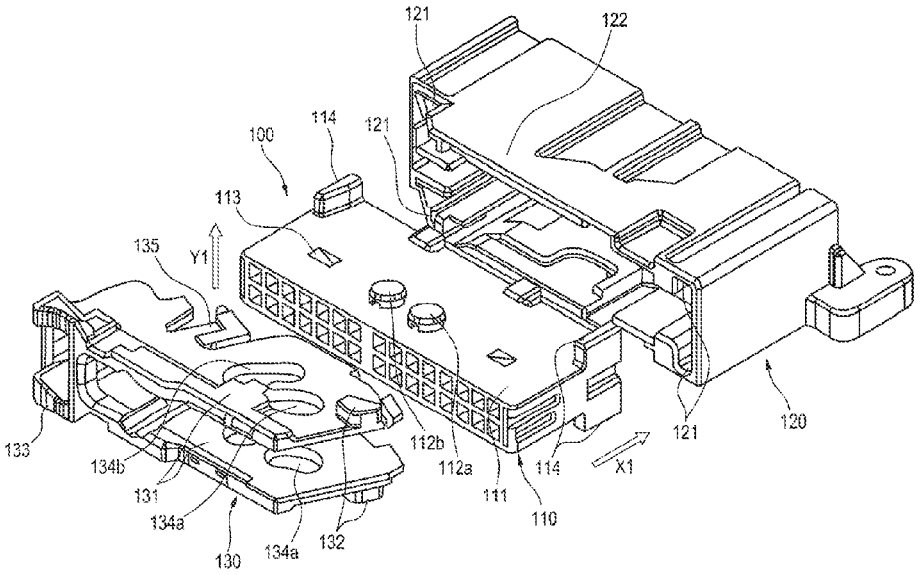
FIG. 12 PRIOR ART
FIG. 12 is an exploded perspective view of a related art lever type connector.
Figure 13:
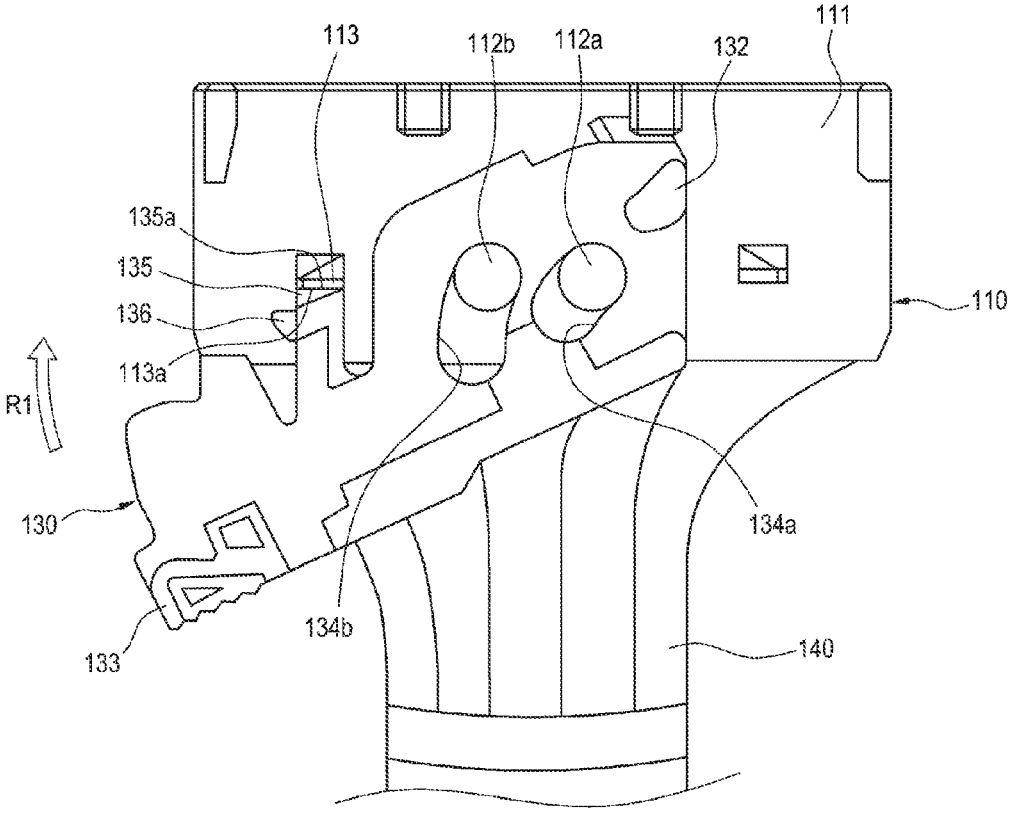
FIG. 13 PRIOR ART
FIG. 13 is a plan view illustrating a state in which a fitting operation lever and a first connector housing of the related art lever type connector are attached together.
Figure 14:
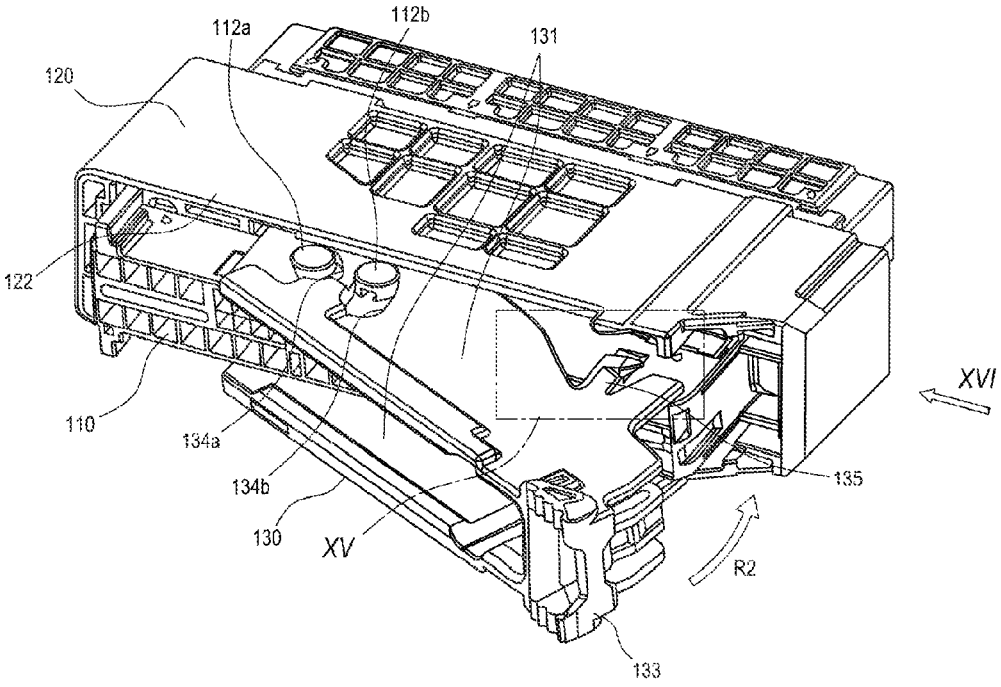
FIG. 14 PRIOR ART
FIG. 14 is a perspective view illustrating a state in which the first connector housing and a second connector housing of the related art lever type connector are put together in the fitting start position.
Figure 15:
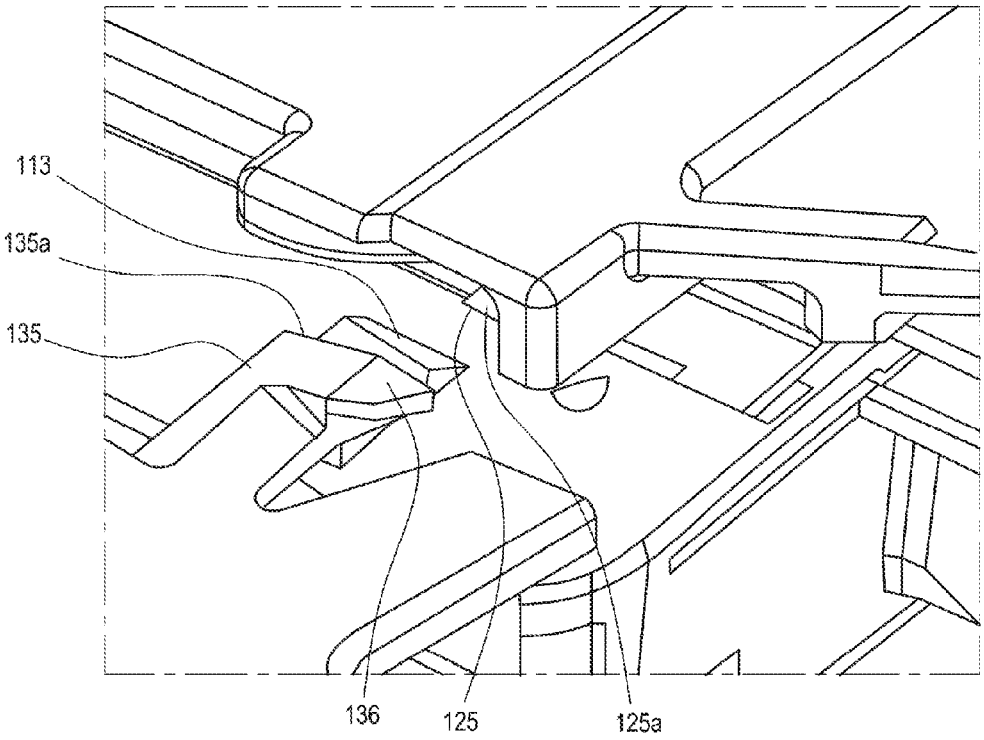
FIG. 15 PRIOR ART
FIG. 15 is an enlarged view of the portion XV in FIG. 14.
Figure 16:
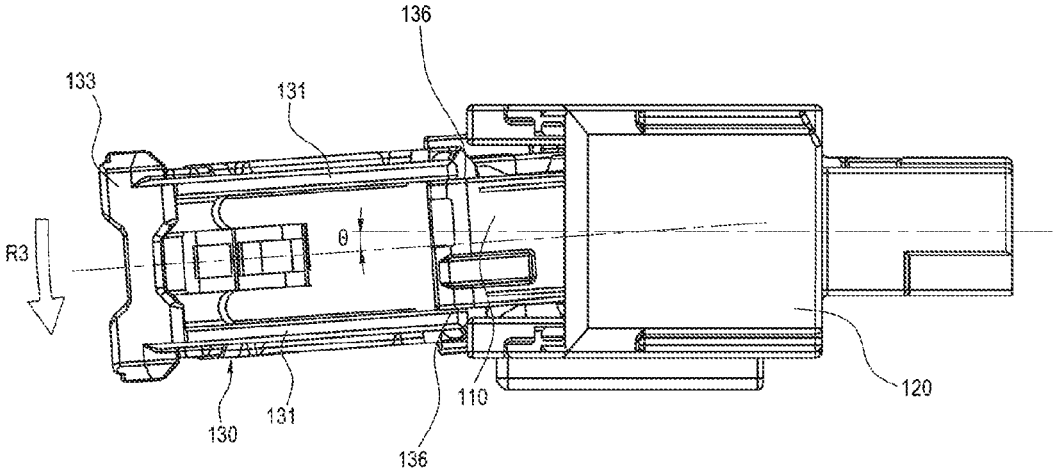
FIG. 16 PRIOR ART
FIG. 16 is a side view as viewed from the direction XVI in FIG. 14.

When the first connector housing 4 and the second connector housing 5 are completely fitted to each other, as shown in FIG. 11, most part of the fitting operation lever 6 is housed inside the hood 51 with not portions projecting outward, whereby a neat appearance of the lever type connector 3 is provided.

According to the lever type connector 3 described above, when the first connector housing 4 on which the fitting operation lever 6 is temporarily locked at the rotation start position and the second connector housing 5 are put together in the fitting start position, the posture holding tabs 65 formed integrally with the respective lever bodies 61 of the fitting operation lever 6 fill the spaces S between the inner surfaces of the side walls of the hood 51 of the second connector housing 5 (the distal end faces 551 of the vertical ribs 55) and the side surfaces 41*b* of the first connector housing 4, whereby as shown in FIG. 10, the first connector housing 4 and the fitting operation lever 6 are held in a posture that is parallel to the inner surfaces of the side walls of the hood 51 of the second connector housing 5.

Therefore, even if a load is produced by electric wires (not shown) leading out of the first connector housing 4, the first connector housing 4 and the fitting operation lever 6 is not inclined due to a play of the first connector housing 4. Therefore, when the connector housings are put together in the fitting start position, the temporal-locking releasing portion 52 provided on the inner surface of the side wall of the hood 51 can reliably release the fitting operation lever 6 from being temporarily locked by the temporarily locking portions 413 of the first connector housing 4.

During work of putting the connector housings 4, 5 together in the fitting start position, no special work or consideration needs to be performed or given to correct inclination of the first connector housing 4 or the fitting operation lever 6. The rotating operation of the fitting operation lever 6 can be started as soon as the connector housings are put together in the fitting start position. As a result, the connector housings can be fitted to each other quickly and the work efficiency can thus be improved.

Furthermore, in the lever type connector 3 according to the exemplary embodiment, the posture holding tabs 65 also serve as wire jamming prevention pieces for preventing an external electric wire from entering into a space between the fitting operation lever 6 and the first connector housing 4 or the second connector housing 5. Therefore, it is not necessary to provide dedicated wire jamming prevention tabs separately from the posture holding tabs 65, as a result of which the structure of the fitting operation lever 6 can be prevented from becoming unduly complex.

Still further, since the wire jamming prevention tabs are provided, an electric wire is prevented from entering into a space between the fitting operation lever 6 and the connector housings and is thereby damaged even if the connector housings are attached to and detached from each other repeatedly.

While the present invention has been described with reference to a certain exemplary embodiment thereof, the scope of the present invention is not limited to the exemplary embodiment described above, and it will be understood by those skilled in the art that various changes and modifications may be made therein without departing from the scope of the present invention as defined by the appended claims.

Aspects of a lever type connector according to one or more exemplary embodiments of the invention are summarized below.

A lever type connector (3) having a first connector housing (4), a second connector housing (5) having a hood (51) into which the first connector housing (4) is fitted, and a fitting operation lever (6) rotatably coupled to a side surface (41*b*) of the first connector housing (4). The fitting operation lever (6) is configured to be operated, in a state in which the first connector housing (4) and the second connector housing (5) are put together in a fitting start position, to rotate from a rotation start position to a rotation end position to completely fit the connector housings to each other. The first connector housing (4) includes a temporarily locking portion (413) provided on the side surface (41*b*) of the first connector housing (4) to temporarily lock the fitting operation lever (6) at the rotation start position. The second connector housing (5) includes a temporal-locking releasing portion (52) provided on an inner surface of a side wall of the hood (51) to release the fitting operation lever (6) from being temporarily locked by the temporarily locking portion (413). The fitting operation lever (6) includes a lever body (61) and a posture holding tab (65) formed integrally with the lever body (61). The posture holding tab (65) is configured to fill a space between the hood (51) and the first connector housing (4) to hold the first connector housing (4) and the fitting operation lever (6) in a posture parallel to the hood (51).

The posture holding tab (65) may extend from the lever body (61) and may be configured as a wire jamming prevention tab that closes a space defined between the fitting operation lever (6) and the first connector housing (4) to prevent an external electric wire from entering the space defined between the fitting operation lever (6) and the first connector housing (4).

What is claimed is:

1. A lever type connector comprising:

a first connector housing;

a second connector housing comprising a hood into which the first connector housing is fitted; and a fitting operation lever rotatably coupled to a side surface of the first connector housing, the fitting operation lever being configured to be operated, in a state in which the first connector housing and the second connector housing are put together in a fitting start position, to rotate from a rotation start position to a rotation end position to completely fit the first connector housing and the second connector housing to each other, wherein the first connector housing comprises a temporarily locking portion provided on the side surface of the first connector housing to temporarily lock the fitting operation lever at the rotation start position, wherein the second connector housing further comprising a temporal-locking releasing portion provided on an inner surface of a side wall of the hood to release the fitting operation lever from being temporarily locked by the temporarily locking portion, and wherein the fitting operation lever comprises a lever body and a posture holding tab formed integrally with the lever body, the posture holding tab being configured to fill a space between the hood and the first connector housing, from the rotation start position to the rotation end position, and to hold the first connector housing and the fitting operation lever in a posture parallel to the hood.

2. The lever type connector according to claim 1, wherein the posture holding tab extends from the lever body and is configured as a wire jamming prevention tab that closes a space defined between the fitting operation lever and the first connector housing to prevent an external electric wire from entering the space defined between the fitting operation lever and the first connector housing.

3. The lever type connector according to claim 1, wherein the space that is filled by the posture holding tab of the fitting operation lever is from a side surface of the first connector housing to a distal end face of a rib provided on an inner surface of the hood.

4. The lever type connector according to claim 3, wherein the side surface of the first connector housing and the distal end face of the rib are within the second connector housing while the first connector housing is fitted into the second connector housing.

* * * * *